US006186393B1

(12) United States Patent
Tsamourgelis

(10) Patent No.: US 6,186,393 B1
(45) Date of Patent: Feb. 13, 2001

(54) CARTON BOX MADE OUT OF SEVERAL BLANKS

(76) Inventor: Ilias Tsamourgelis, 8 Kleonon Street, GR-111 42 Athens (GR)

( * ) Notice: Under 35 U.S.C. 154(b), the term of this patent shall be extended for 0 days.

(21) Appl. No.: 09/180,765

(22) PCT Filed: Jun. 30, 1997

(86) PCT No.: PCT/GR97/00024

§ 371 Date: Nov. 12, 1998

§ 102(e) Date: Nov. 12, 1998

(87) PCT Pub. No.: WO98/00344

PCT Pub. Date: Jan. 8, 1998

(30) Foreign Application Priority Data

Jul. 1, 1996 (GR) ..... 960100223

(51) Int. Cl.[7] ..... B65D 5/12
(52) U.S. Cl. ..... 229/122.26; 229/191; 229/122.21
(58) Field of Search ..... 229/191, 918, 229/122.26, 122.21, 193

(56) References Cited

U.S. PATENT DOCUMENTS

| | | | | |
|---|---|---|---|---|
| 1,607,050 | * | 11/1926 | Boeye | 229/122.21 |
| 1,638,719 | * | 8/1927 | Adamson | 229/122.21 X |
| 3,162,351 | * | 12/1964 | Rudofski | 229/191 X |
| 3,709,425 | * | 1/1973 | Stapp | 229/199 |
| 4,056,223 | * | 11/1977 | Williams | 229/191 X |
| 5,333,777 | * | 8/1994 | Roth | 229/122.21 X |

FOREIGN PATENT DOCUMENTS

| | | | | |
|---|---|---|---|---|
| 0 394 544 | | 10/1990 | (DE) . | |
| 0 573 381 A1 | | 12/1993 | (EP) . | |
| 0 621 192 A1 | | 10/1994 | (EP) . | |
| 1358881 | | 6/1963 | (FR) . | |
| 1409752 | | 4/1964 | (FR) . | |
| 0 538 098 A1 | | 4/1993 | (FR) . | |
| 0783801 | * | 10/1957 | (GB) | 229/918 |
| 2232404 | * | 12/1990 | (GB) | 229/122.26 |
| WO 97/08060 | | 3/1997 | (WO) . | |

* cited by examiner

*Primary Examiner*—Allan N. Shoap
*Assistant Examiner*—Tri M. Mai
(74) *Attorney, Agent, or Firm*—Herbert Dubno

(57) ABSTRACT

The invention refers to an economical carton box for packing and transporting of products that can consist of many pieces of corrugated board or solid paper so as in each case and for each side separately the arrangment of the paper's waves is to be indicated. For such an economical carton box the extensions (F1, F2, . . . , F6) of sides (A1, A2, A3) turn internally by 90 degrees so as to be glued with the outside part of the small sides (A4, A5) accordingly and the extensions (F7, F8) to base A2. The extensions (N1, N2) rotate and glue externally to sides (A4 and A5) while columns (K1, K2, K3, K4) are formed at the small sides. When the height of the sides (A1, A3) is equal to the height of the carton box then the extensions (N1, N2) constitute the covering of the carton box. The projections (P1, P2, P3, P4) of sides (A4 and A5) fit into slots (E1, E2, E3, E4) accordingly during the piling of the boxes.

5 Claims, 11 Drawing Sheets

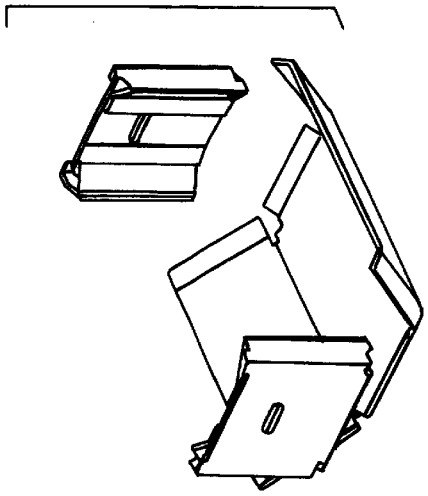
FIG.29
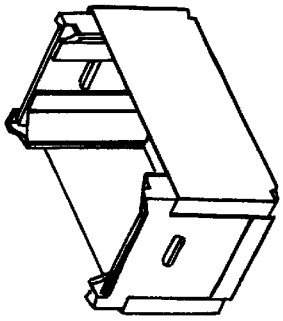
FIG.30
FIG.28
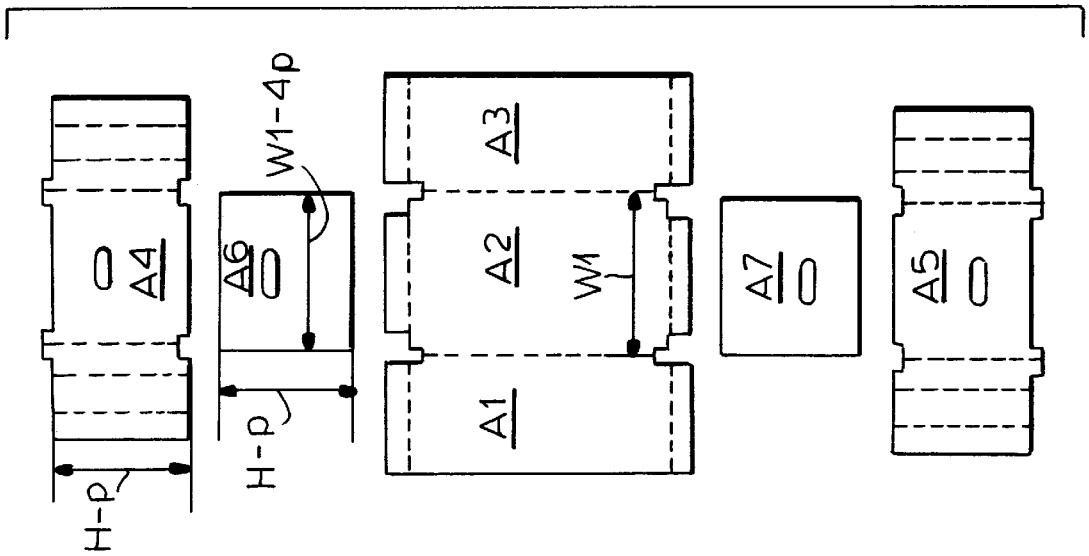

CARTON BOX MADE OUT OF SEVERAL BLANKS

CROSS REFERENCE TO RELATED APPLICATIONS

This application is a national stage of PCT/GR97/00024 filed Jun. 30, 1997 and based upon Greek national application 96 01 00223 filed Jul. 1, 1996 under the International Convention.

FIELD OF THE INVENTION

The invention relates to an economical carton or box which is very strong and useful for the packing and transportation of agricultural and industrial products.

BACKGROUND OF THE INVENTION

Many boxes are known for use in packing and transportation of agricultural and industrial products which are formed by a single paper blank. The blank of this paper, which is usually large, is a problem since during the production of the corrugated board it is not always possible to economically limit the waste.

Also the corrugations of the corrugated board out of which a carton or box is constructed always run in one direction so that certain sides of the box lack strength not because the quality or the paper weight are not satisfactory but due to the inappropriate orientation of the corrugations of the corrugated board.

OBJECT OF THE INVENTION

It is the object of the invention to provide an improved cardboard box. The advantage of this invention is that a carton, box or tray can be constructed from different pieces of corrugated board or solid paper that are held together with glue.

In this way the combinations in the corrugated board or solid paper productive lines become much easier since the blanks are smaller and moreover at each side of the carton box, papers with the appropriate paper or, extension can be used and to yield a very economical and strong carton box.

SUMMARY OF THE INVENTION

The cardboard box of the invention, which is useful for packing and transportation of agricultural and industrial products, is made up of a number of blanks or pieces including a base, longitudinal walls connected to the base along the longitudinal base thereof and either in one piece with the base or as separate pieces, and end walls connected to the base at end edges thereof. The end walls and the base are glued together for extensions on the end walls have sides which can be followed inwardly to form columns of the box, at the corners betweens these side walls and the longitudinal walls. The longitudinal walls have extensions which extend around and are glued to the outer surfaces of the end walls at these columns. Projections on the end walls and slots formed in the base enable stacks of boxes to be aligned with the projections of one of the boxes engaging in the slots of another box.

BRIEF DESCRIPTION OF THE DRAWING

The above and other objects, features, and advantages will become more readily apparent from the following description, reference being made to the accompanying drawing in which:

FIG. 28 is a layout diagram which shows the blank of the economical cardboard box according to the invention in case that paper addition at the small sides is used in order to reinforce its strength;

FIG. 29 is an exploded view which demonstrates the way the formation is arranged according to the invention; and FIG. 30 is a perspective view which shows the appearance of a formed economical cardboard box according to the invention.

SPECIFIC DESCRIPTION

The reference regards the one fourth or one half of the cardboard box for each case because of its symmetry against both the horizontal and vertical axis that go through its center.

Each paper member may have different thickness but all of the embodiments show the thicknesses will be considered to be the same and equal to p.

Figure 1:
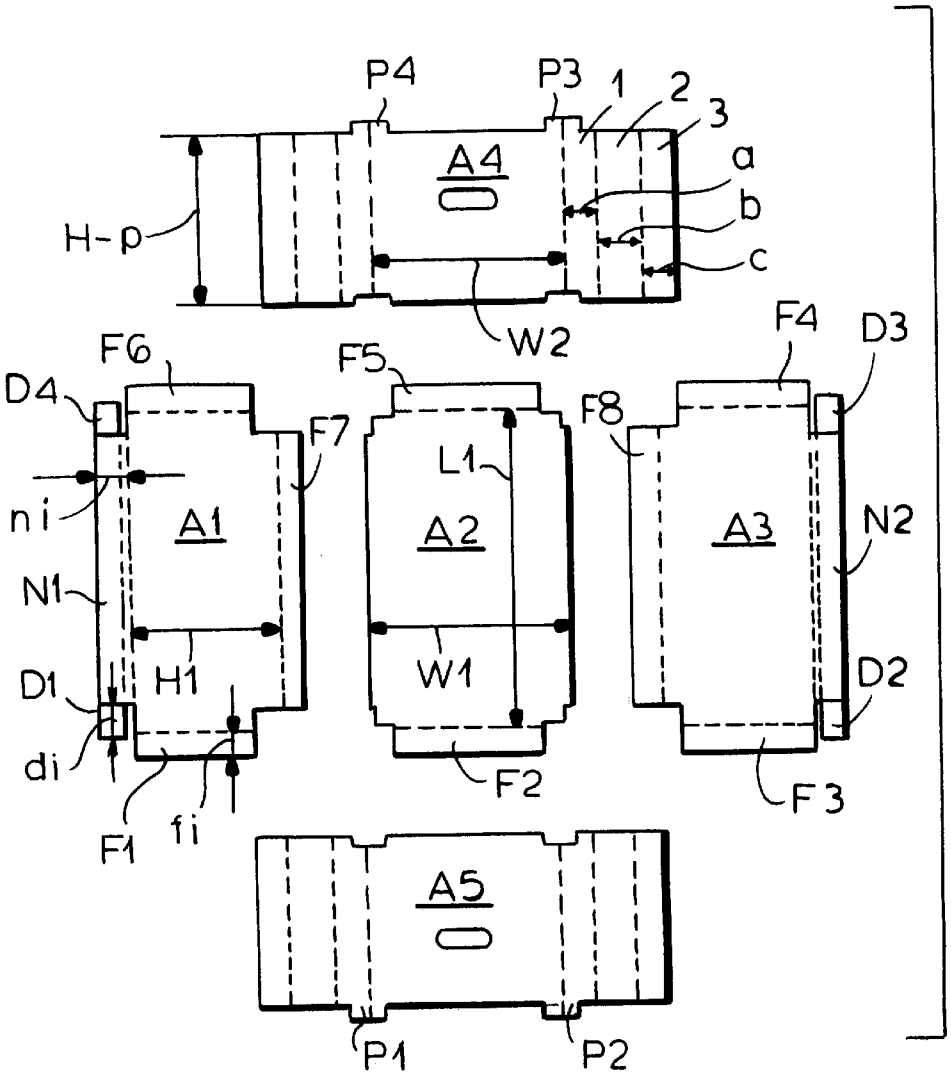
FIG. 1 is a layout diagram which shows the blank of the economical cardboard box according to the invention in case that all the cardboard box's sides and its base consist of different pieces of paper and triangular columns are formed in its corners and inner paper refolding are formed in the large sides.
Figure 2:
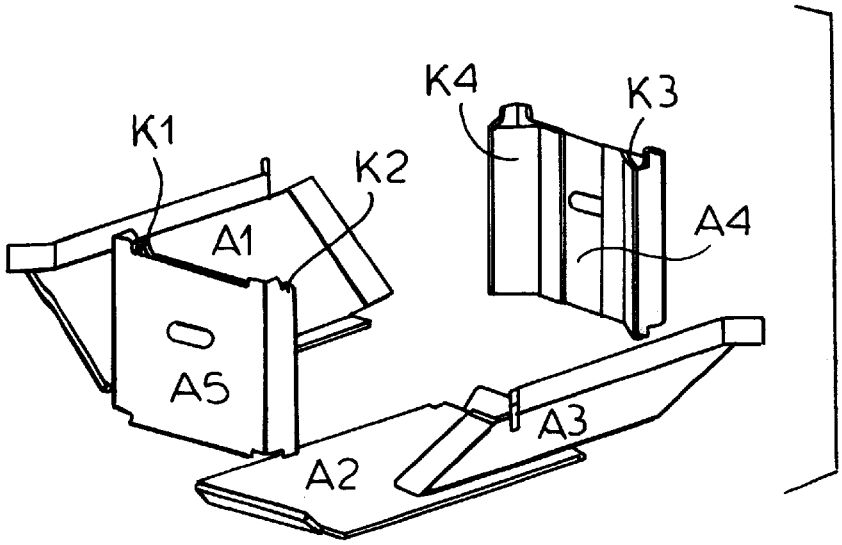
FIG. 2 is an exploded view which demonstrates the way the formation is arranged according to the invention.

FIG. 1 shows pieces of corrugated board or solid paper that are being cut and folded according to it so as the sides A1, A2, A3 of the carton box can be formed as well as their extensions F1, F2, . . . , F8 to fi length, the N1, N2 of ni length, the D1, D2, D3, D4 of di width, the K1, K2, K3, K4, which are formed by a relevant refolding of the 1, 2, 3 surfaces a, b, c length and equivalently the projections P1, P2, P3, P4.

Figure 3:
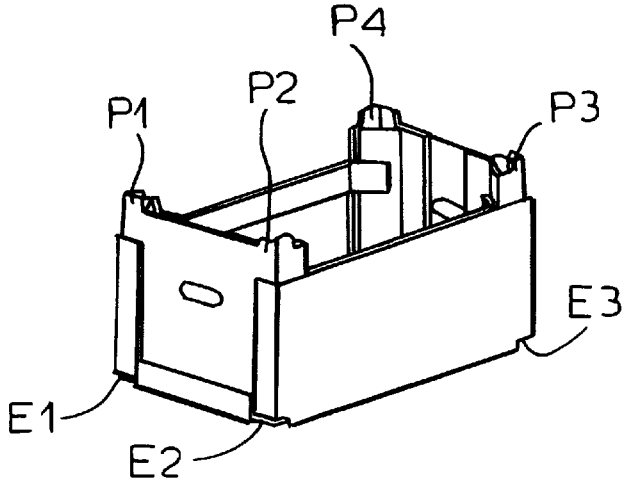
FIG. 3 is a perspective view which shows the appearance of a formed economical cardboard box according to the invention.

Also at all paper surfaces relevant cuts are made in order finally to provide the slots E1, E2, E3, E4 of a box of FIG. 3 shows and whose dimensions are equivalent to those of the projections P1, P2, P3, P4 so as during the stacking of the boxes their appropriate fixing can be accomplished.

According to the present invention at A4 and A5 sides the surfaces 3 of c length rotate through 45° externally (in cases the triangular column is isosceles), also the surfaces 2 of b length rotate through 135° internally and finally the surfaces 1 at length a rotate internally by 90° so that the inner side of surfaces 3 touch the sides A4 and A5 and thus the triangular columns K1, K2, K4, K4 are formed.

Also surfaces F7 and F8 of A1 and A3 sides equivalently glue together with A2 side so that a single rectangular parallelogram is formed with A2 side usually above the surface F7 and F8. The dimensions of this single surface are $[W1+2(H1+ni)]\times(l1+2fi)$.

The A1 and A3 sides rotate internally by 90° and afterwards the A4 and A5 sides are brought vertically towards the A1, A2, A3 surfaces with the projections P1, P2, P3, P4 placed upwards and in such position that the surfaces F1, F2, F3 and F4, F5, F6 when rotated internally by 90° touch the A5 and A4 sides so that the gluing together of all the box's sides can be finally accomplished by the insertion of the glue.

Afterwards the N1, N2 sides rotated internally by 180° are glued together with A1 and A3 sides equivalently while the D1, D2, D3, D4 tabs are glued on the small sides of the carton box and particularly on their surfaces 2.

The carton box that is formed by this way has external dimensions with length $L=L1+2p$, width $W=W1+2p=W2+4p$ and height H (without estimating the height of projections P1, P2, P3, P4).

With accordance to the ventilation demands of the packed products an air gap is formed which is defined by the difference of height H of the carton and sides A1 and A3 with height H1, that means $(H-H1)$.

Regarding the fi and ni lengths of the extensions Fi/i=1, 2, . . . , 8 and Ni/i=1,2, $fi>0$ and $0\leqq ni\leqq H1-p$ valid. Also $0\leqq di\leqq b+c$ when $ni>0$.

The extensions F7, F8 instead of being provided on sides A1, A3 can be extensions of base A2 of the carton box and F2, F5 which are extensions of A2 can be extensions of sides A5 and A4 accordingly.

Figure 5:
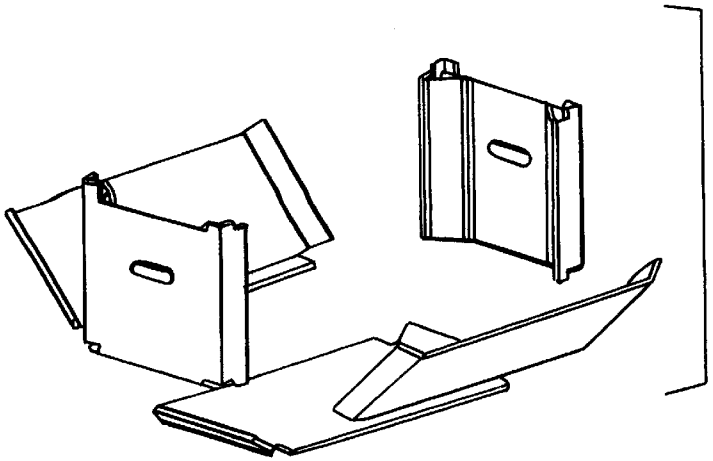
FIG. 5 is an exploded view which demonstrates the way the formation is arranged according to the invention.
Figure 6:
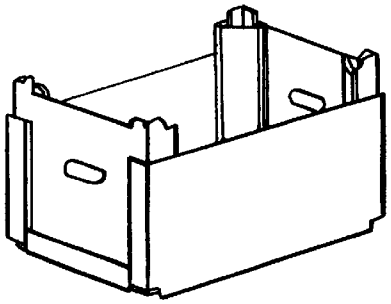
FIG. 6 is a perspective view which shows the appearance of a formed economical cardboard box according to the invention.
Figure 4:
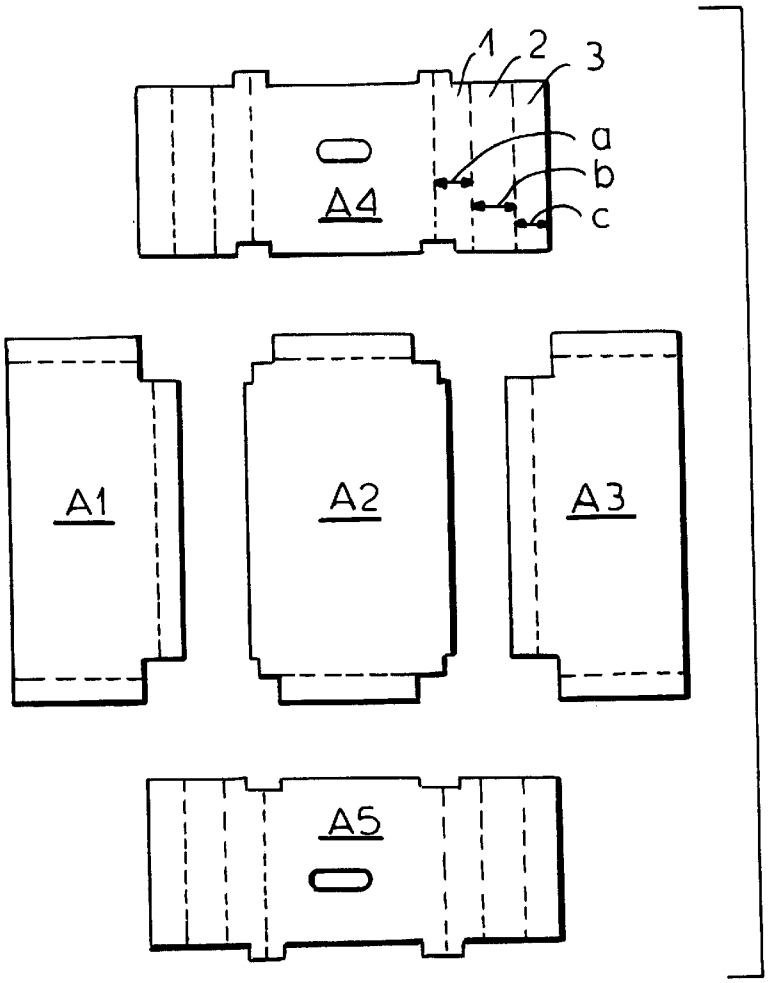
FIG. 4 is a layout diagram which shows the blank of the economical cardboard box according to the invention whose triangular columns are different from those of FIG. 1 and there are no inner paper refolding in the large sides of the cardboard box.

FIGS. 4–6 according to the invention show surfaces of corrugated board or solid paper which are cut and folded so that during their formation, FIG. 5 here arises the box of FIG. 6.

According to the present invention at A4 and A5 surfaces 3 rotate inwardly by 135°, then surfaces 2 turn internally by 135° and finally surfaces 1 rotate internally by 90° with the consequence the outer side of surfaces 1 to be touched and glued with A4 and A5. In this case ni=0 and for length c valid $0<c\leqq v^{-}[b^2-(a-p)^2]$.

Figure 8:
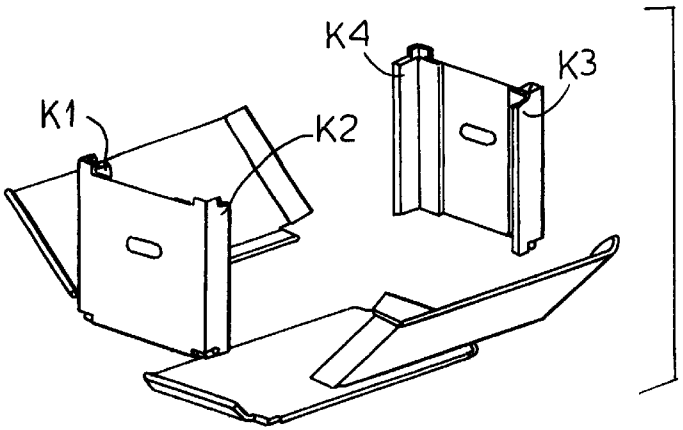
FIG. 8 is an exploded view which demonstrates the way the formation is arranged according to the invention.
Figure 9:
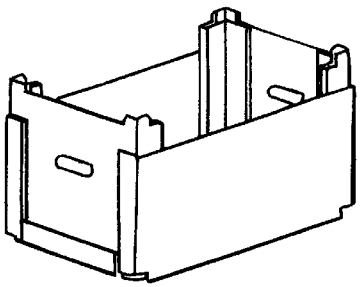
FIG. 9 is a perspective view which shows the appearance of a formed box according to the invention.
Figure 7:
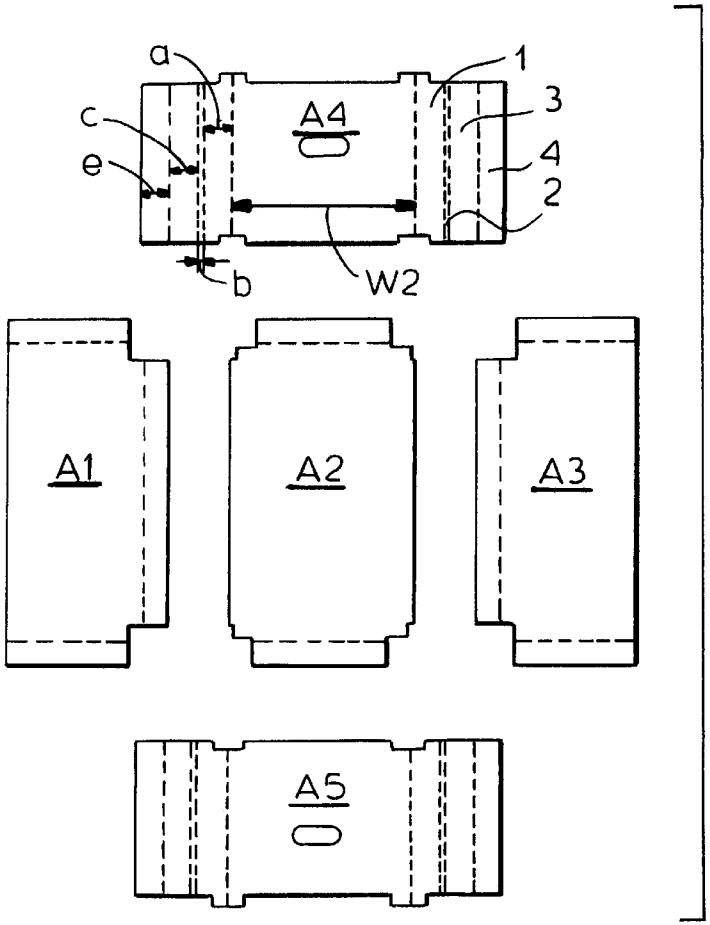
FIG. 7 is a layout diagram which shows the blank of the economical box according to the invention at which with relevant paper refolding its corners become double.

FIGS. 7–9 according to the invention show surfaces of corrugated board or solid paper which are cut and folded, FIG. 8, to yield the box of FIG. 9.

In this case at sides A4 and A5 the columns K1, K2, K3, K4 that are formed become by the orderly external rotation of surfaces 4 by 90°, the internal rotation of surfaces 3 by 90°, of 2 internally by 90° and finally of 1 internally by 90°.

For lengths a, b, c, e $c=a-2p$, $b=2p$, $0\leqq e\leqq(W2/2-2p)$ valid.

Especially when e=0 then $0\leqq c\leqq a-2p$.

Figure 11:
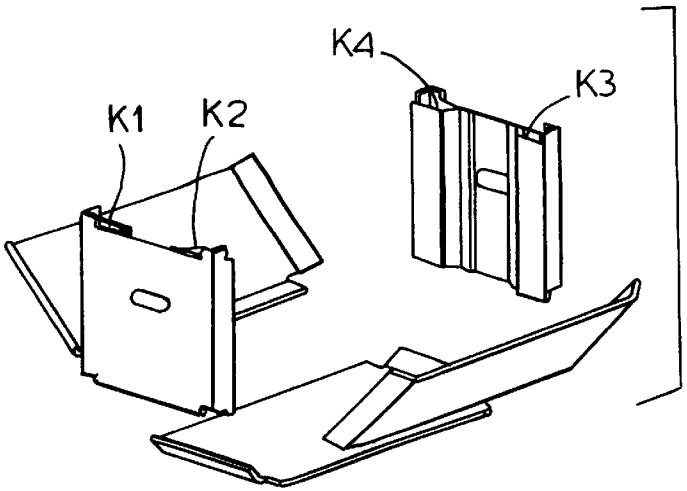
FIG. 11 is an exploded view which demonstrates the way the formation is arranged according to the invention.
Figure 12:
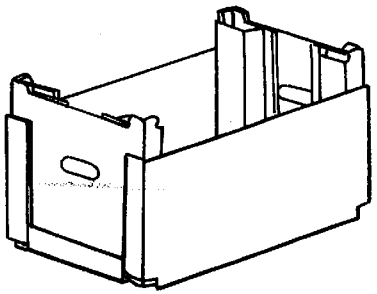
FIG. 12 is a perspective view which shows the appearance of a formed box according to the invention.
Figure 10:
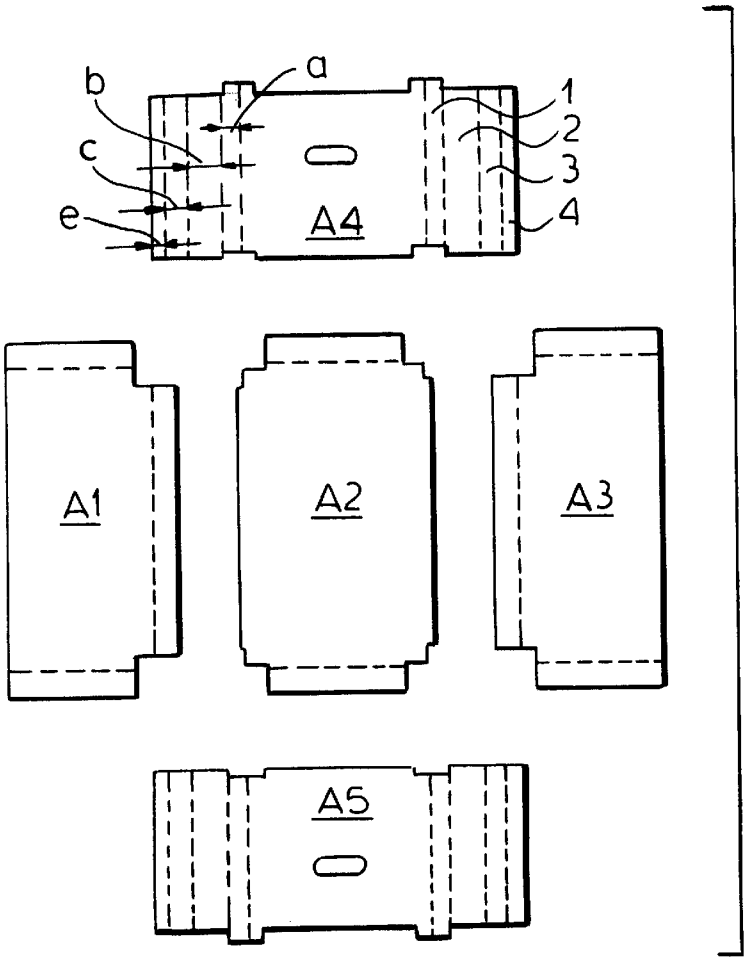
FIG. 10 is a layout diagram which shows the blank of the economical carton box according to the invention whose columns have the shape of a rectangular trapezium.

FIGS. 10–12 according to the invention show surfaces of corrugated board or solid paper that are cut and folded, FIG. 11, to be yield the box of FIG. 12.

In this case at A4 and A5 the rotations of surfaces 1, 2, 3, 4 are effected so that columns K1, K2, K3, K4 have the shapes of a rectangular trapezium and attached surface the inner side of 4. Here $a>2p$, $b\neq 0$, $c>a-p$.

Figure 14:
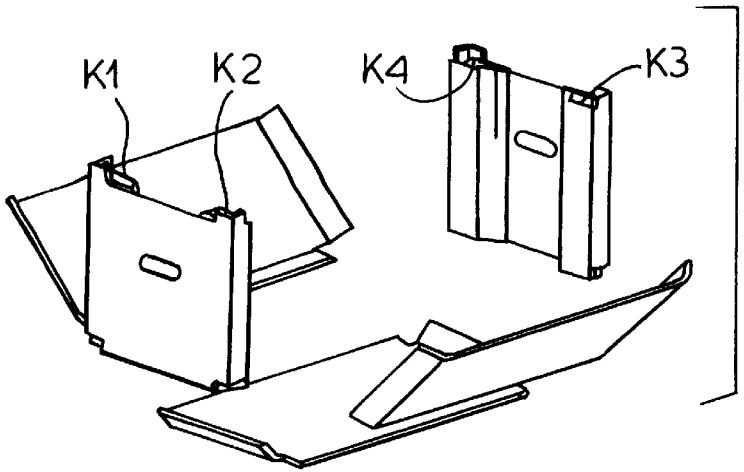
FIG. 14 is an exploded view which demonstrates the way the formation is arranged according to the invention.
Figure 15:
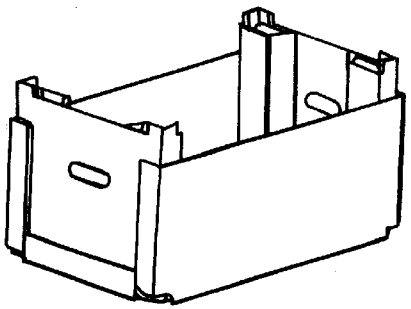
FIG. 15 is a perspective view which shows the appearance of a formed box according to the invention.
Figure 13:
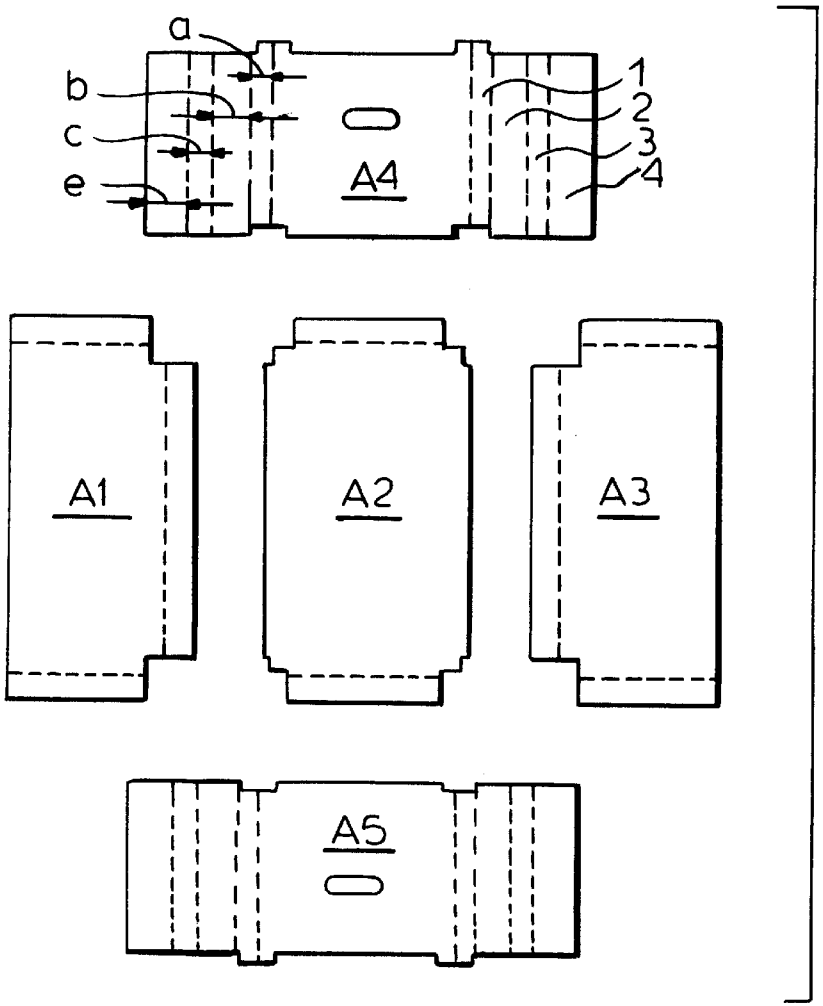
FIG. 13 is a layout diagram which shows the blank of the economical carton box according to the invention whose columns have the shape of a rectangular trapezium which is however formed in a different way from that in FIG. 10.

FIGS. 13–15 according to the invention show surfaces of corrugated board or solid paper that are cut and folded, FIG. 14 to give the box of FIG. 15.

In this case at A4 and A5 the rotations of surfaces 1, 2, 3, 4 are effected so as columns K1, K2, K3, K4 to have the shape of rectangular trapezium and attached surfaces the external side of 4. Here valid $a>2p$, $b\neq 0$, $0<e\leqq(b-p)+v^{-}[c-p^2-(a-p)^2]$.

Figure 17:
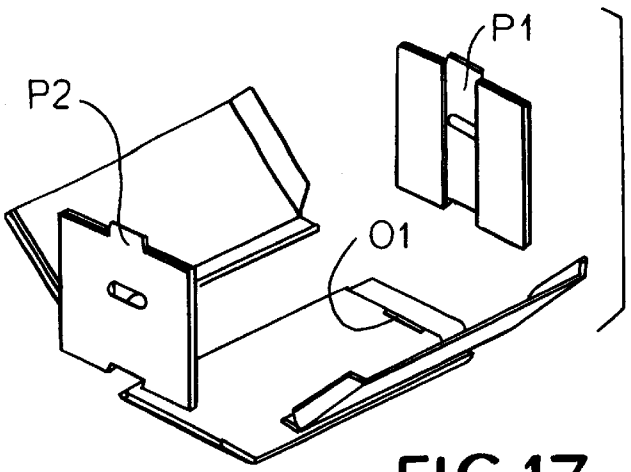
FIG. 17 is an exploded view which demonstrates the way the formation is arranged according to the invention.
Figure 18:
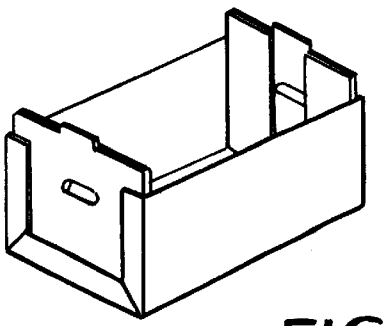
FIG. 18 is a perspective view which shows the appearance of a formed economical carton box according to the invention.
Figure 16:
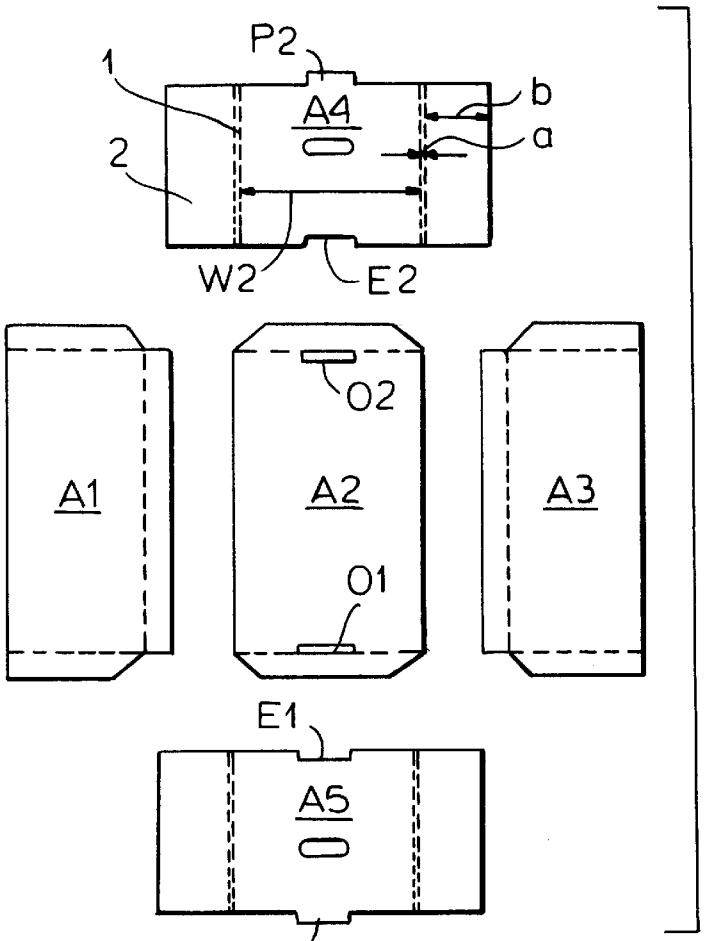
FIG. 16 is a layout diagram which shows the blank of a cardboard box according to the invention in which the paper refolding that are made at its small sides have as a result that these sides are formed by successive flat sheets of papers.

FIGS. 16–18 according to the invention show surfaces of corrugated board or solid paper that are cut and folded, FIG. 17 to yield box of FIG. 18.

According to the invention the surface 2 turns internally by 90° against the 1 and the 1 internally by 90° too.

In this case a=2b and 2b≦W2 valid.

In case that surfaces A4, A5 are the same to each other but not symmetrical to the axis which passes vertically through their center and valid one out of a to be equal to 2p and the other equal to 3p then the sides A4 and A5 are formed by three successive sheets of paper and then valid (W2/2) <b≦W2.

On base A2 are formed grooves O1 and O2 so that projections P1 and P2 fit to them during the box stack. When the height of projections P1 and P2 is bigger than p then we have to cut equivalent slots E1 and E2 to the sides A5 and A4.

Figure 20:
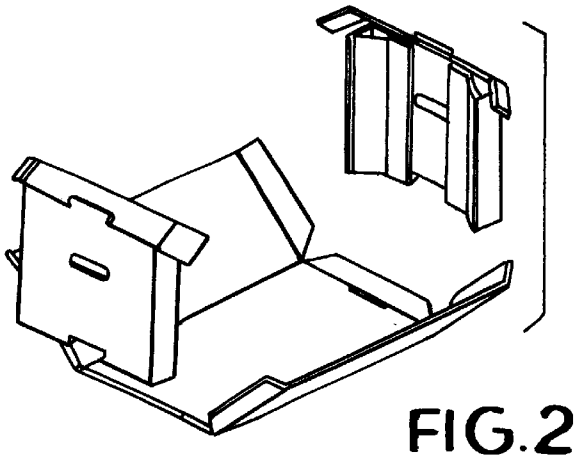
FIG. 20 is an exploded view which demonstrates the way the formation is arranged according to the invention.
Figure 21:
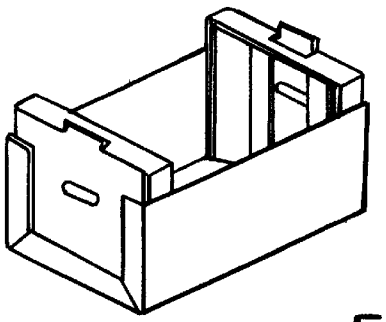
FIG. 21 is a perspective view which shows the appearance of a formed economical cardboard box according to the invention.
Figure 19:
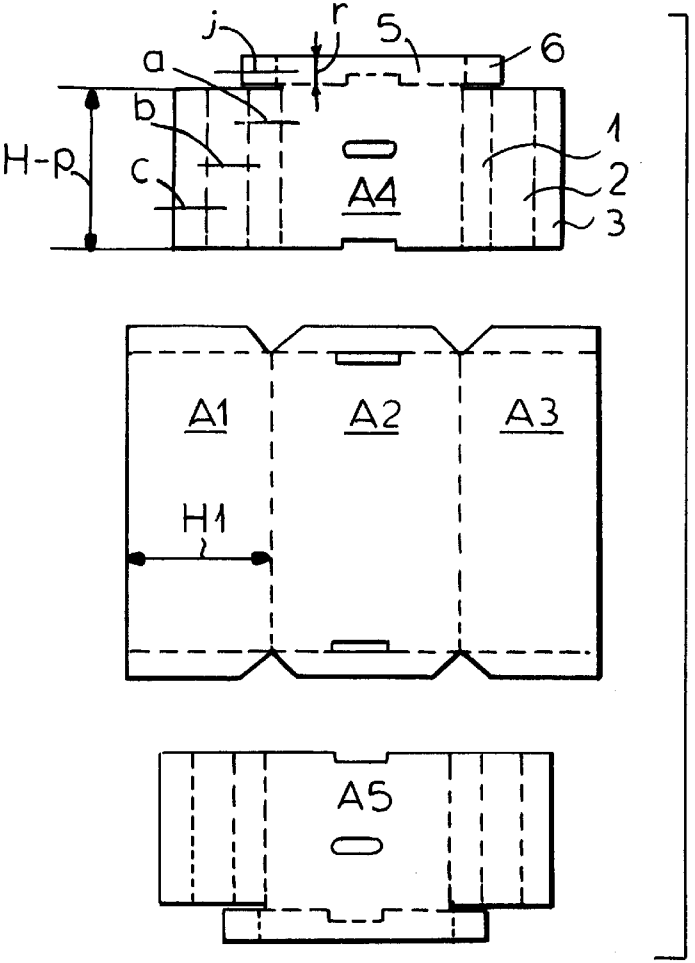
FIG. 19 is a layout diagram which shows the blank of an economical cardboard box according to the invention at which the upper extensions of the small sides are refolded accordingly and both the large sides and the base of the cardboard box are formed by a single piece of corrugated board or solid paper.

FIGS. 19–21 according to the invention show surfaces of corrugated board or solid paper that are cut and folded, FIG. 20 to give the box of FIG. 21.

In this case the extension 5 of A4 and A5 rotate internally by 90° and afterwards the 6 internally by 90° too so as finally to be glued with A4 and A5 conditioning that H1+j≦H+2p. Than r≦a also valid. When H1=H−p then surfaces 6 glue together with sides A1 and A3 and r≠0 and j≦H1 valid.

Also according to the present invention sides A1, A2 and A3 can consist of a single surface of paper as FIG. 19 shows.

Figure 23:
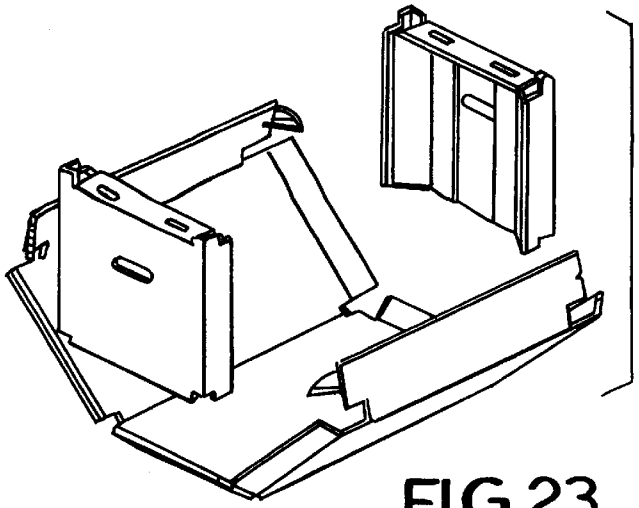
FIG. 23 is an exploded view which demonstrates the way the formation is arranged according to the invention.
Figure 24:
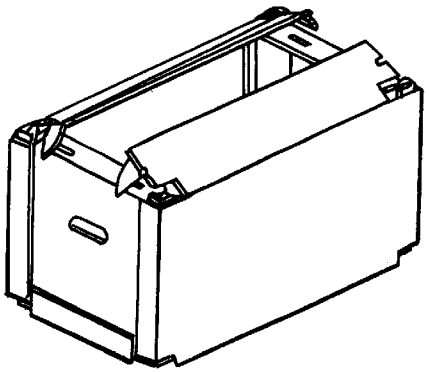
FIG. 24 is a perspective view which shows the appearance of a formed economical cardboard box according to the invention.
Figure 22:
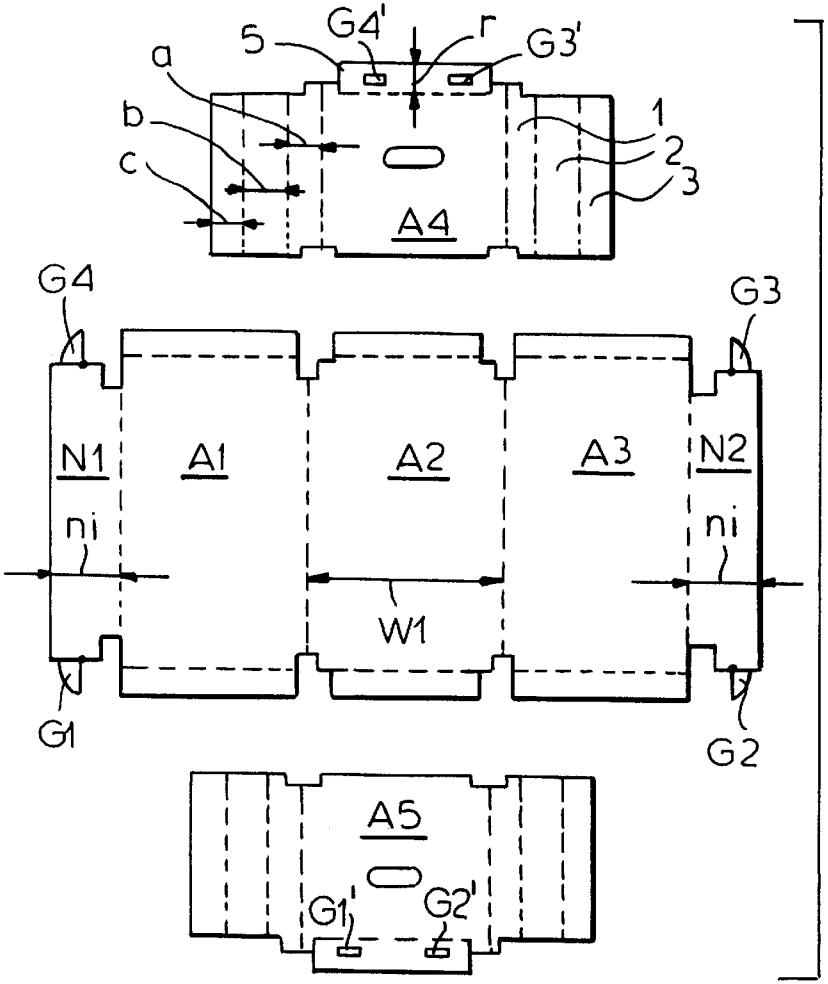
FIG. 22 is a layout diagram which shows the blank of the economical carton box according to the invention in which the large sides are extended accordingly and on these extensions there are hooks so as the carton box is covered while on the extensions of the small sides there are specific slots for the penetration of the hooks.

FIGS. 22–24 according to the invention show surfaces of corrugated board or solid paper that are cut and folded, FIG. 23, to give the box of FIG. 24.

According to the invention when the height of sides A1 and A3 is equal to the height of box H then the projections N1, N2 of these sides accordingly being rotated internally by 90° function as the covering of the box.

Surfaces G1, G2, G3, G4 having the shape of hooks insert into the relevant slots G1', G2', G3', G4' that there are on surfaces 5 which have first been rotated to the inner side of the box by 90° as FIG. 24 shows.

The equation r>2p, 2ni≦W1 is valid.

Figure 26:
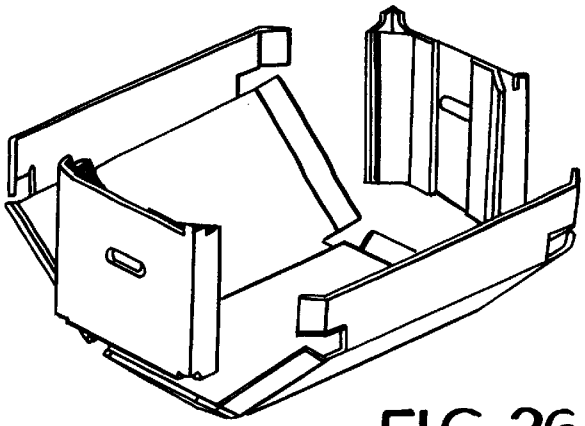
FIG. 26 is an exploded view which demonstrates the way the formation is arranged according to the invention.
Figure 27:
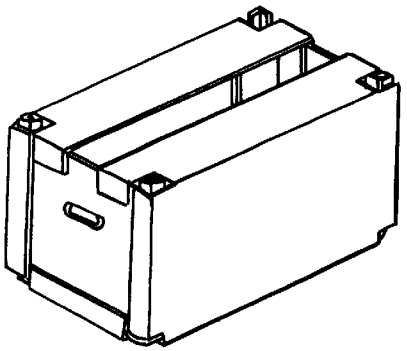
FIG. 27 is a perspective view which shows the appearance of a formed economical cardboard box according to the invention.
Figure 25:
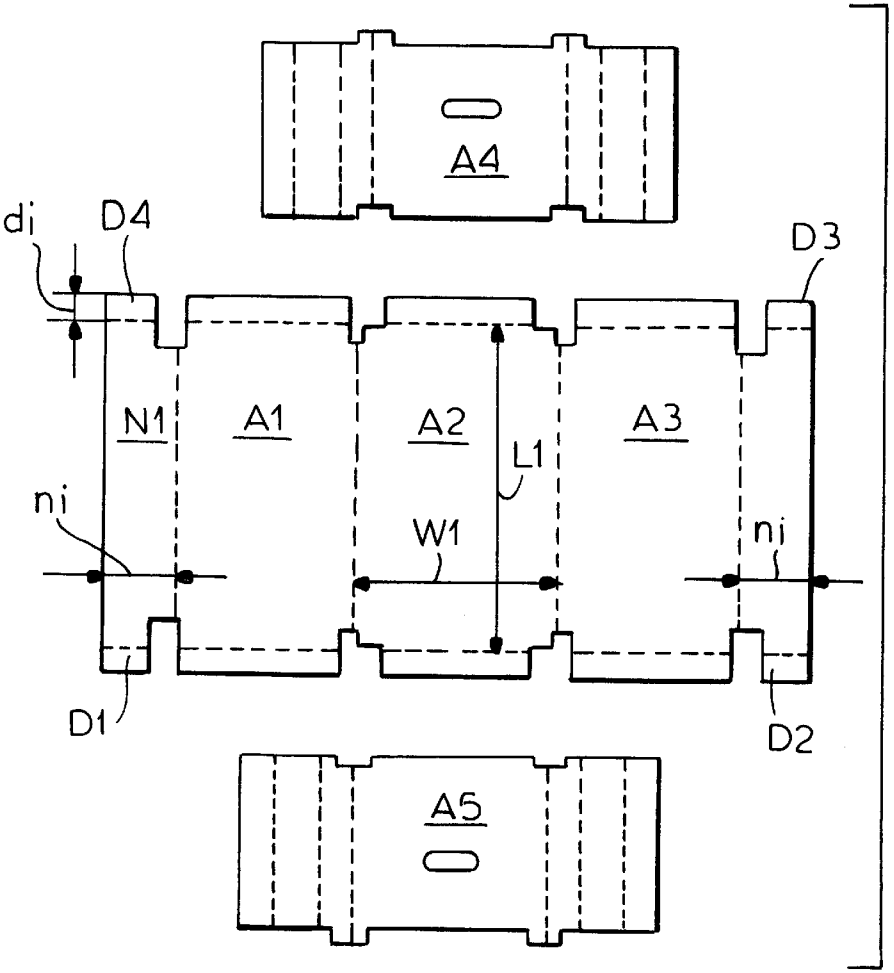
FIG. 25 is a layout diagram which shows the blank of the economical cardboard box according to the invention whereby the large sides are extended so that the carton box is covered and the small sides are glued together.

FIGS. 25–27 according to the invention show surfaces of corrugated board or solid paper that are cut and folded, FIG. 26, to be the box of FIG. 27.

In this case surfaces D1, D2, D3, D4 glue externally with A4 and A5 and in case that di=0 and 2ni>w1 then surfaces N1 and N2 can be glued together since they touch each other.

When di=0 and 2ni<W1 valid then the creation of a cover the whole surface of the carton box becomes by the insertion under the N1 and N2 of another paper surface of maximum dimensions L1×W1 that each of N1 and N2 glues with this surface.

FIGS. 28–30 according to the invention show surfaces of corrugated board or solid paper that are cut and folded, FIG. 29, to the box of FIG. 30.

In this case in the inner part of sides A4 and A5 of the box the flat surfaces of paper A6 and A7 dimensioned (H−p)×(W1−4p) are glued together and afterwards the refolding of the surfaces 1, 2, 3 and 1, 2, 3, 4 take place according to the shape that each time the columns K1, K2, K3, K4 have or the surfaces 1, 2 in case that columns do not exist.

Generally in accordance with the present invention the sides A1, A2, A3 not only each of them can be a separate part of a corrugated board or solid paper or be formed by a single surface of an undulating or solid paper, but also can be formed for each two continuous sides by one single piece of paper.

According to the present invention in each above mentioned case relevant to the packed product the means of transport, the conditions of warehousing, etc., handles and holes or ventilation are formed in the pieces of the economical cardboard box.

What is claimed is:

1. A cardboard box for packing and transportation of agricultural and industrial products, said cardboard box comprising:

a paperboard base having longitudinal edges and end edges;

respective paperboard longitudinal walls connected to said base along said longitudinal edges and perpendicular to said base;

respective paperboard end walls connected to said base at said end edges by strips on one of said end walls and said base glued to the other of said end walls and said base respectively, said end walls being perpendicular to said base, each of said end walls having inwardly folded extensions clued to inner surfaces of said end walls along vertical sides thereof to form respective vertical columns along junctions between said end walls and said longitudinal walls, said longitudinal walls being formed with respective extensions folded over and glued to outer surfaces of said end walls at said junctions; and projections on said end walls and slots formed in said base whereby, upon stacking of the box with a similar box, the projections of one of the boxes engages in the slots of the other box, each of said longitudinal walls having an inwardly folded longitudinal flap along an upper edge thereof glued to an inner surface of the respective longitudinal wall, each of said longitudinal flaps having an extension glued to a respective one of said columns.

2. The cardboard box defined in claim 1 wherein the extensions on each of said end walls are each comprised of a plurality of panels including a first panel folded at 90° to the respective end wall, a second panel folded at 45° to the first panel and a third panel folded at 45° to the second panel and glued to the respective said inner surface of said end wall.

3. The cardboard box defined in claim 1 wherein each of said columns is of triangular cross section.

4. The cardboard box defined in claim 1 wherein said projections are formed at corners between respective inwardly folded extensions and the respective end walls.

5. The cardboard box defined in claim 1 wherein said longitudinal end walls are separate from said base and are attached by gluing to said base along respective longitudinal flaps formed on one of said bases and said longitudinal walls.

* * * * *